US010286936B2

(12) United States Patent
Koller

(10) Patent No.: US 10,286,936 B2
(45) Date of Patent: May 14, 2019

(54) DEVICE FOR DETECTING OBSTACLES FOR RAIL VEHICLES

(71) Applicant: Siemens AG Oesterreich, Vienna (AT)

(72) Inventor: Andreas Koller, Sankt Marein bei Knittelfeld (AT)

(73) Assignee: Siemens AG Österreich, Vienna (AT)

( * ) Notice: Subject to any disclaimer, the term of this patent is extended or adjusted under 35 U.S.C. 154(b) by 199 days.

(21) Appl. No.: 15/121,303

(22) PCT Filed: Feb. 25, 2015

(86) PCT No.: PCT/EP2015/053928
§ 371 (c)(1),
(2) Date: Aug. 24, 2016

(87) PCT Pub. No.: WO2015/135752
PCT Pub. Date: Sep. 17, 2015

(65) Prior Publication Data

US 2017/0015335 A1 Jan. 19, 2017

(30) Foreign Application Priority Data

Mar. 12, 2014 (AT) ..... A 50180/2014

(51) Int. Cl.
*B61L 23/04* (2006.01)
*B61K 9/08* (2006.01)
*B61H 13/00* (2006.01)

(52) U.S. Cl.
CPC ..... *B61L 23/041* (2013.01); *B61K 9/08* (2013.01); *B61H 13/00* (2013.01); *B61L 2201/00* (2013.01)

(58) Field of Classification Search
CPC ..... B61L 23/00; B61L 23/04; B61L 23/041; B61L 23/042; B61L 23/044; B61L 23/34
See application file for complete search history.

(56) References Cited

U.S. PATENT DOCUMENTS 4,932,618 A * 6/1990 Davenport ..... B61L 1/02 180/169
7,770,847 B1 8/2010 Severson
(Continued)

FOREIGN PATENT DOCUMENTS

CN 102310866 1/2012
CN 102407862 A 4/2012
(Continued)

OTHER PUBLICATIONS

Data Sheet dated Jul. 24, 2017 which issued in the corresponding Chinese Patent Application No. 201580013541.0.

*Primary Examiner* — Robert J McCarry, Jr.
(74) *Attorney, Agent, or Firm* — Cozen O'Connor

(57) ABSTRACT

A device for detecting obstacles for a rail vehicle includes a pilot bar, which is retained on the bogie frame of the rail vehicle in front of the wheelset that is positioned first in the direction of travel via a mounting retainer, wherein the mounting retainer is formed by vertically arranged spring elements, in particular leaf springs, where each leaf spring is fastened at an upper end to the bogie frame and at a lower end to the pilot bar, where each leaf spring includes a stress-strain converter which is arranged between the upper end and the lower end on a broad surface of a leaf spring, and where each stress-strain converter is connected to an on-board evaluator via a signal-conducting connection.

7 Claims, 3 Drawing Sheets

(56) References Cited

U.S. PATENT DOCUMENTS

| | | | | |
|---|---|---|---|---|
| 2010/0148013 | A1 | 6/2010 | Bhotika et al. | |
| 2011/0276203 | A1* | 11/2011 | Hase | B61K 9/08 701/19 |

FOREIGN PATENT DOCUMENTS

| | | | |
|---|---|---|---|
| CN | 103303338 | | 9/2013 |
| CN | 103523040 | | 1/2014 |
| DE | 378143 | C | 7/1923 |
| EP | 1808340 | | 7/2007 |
| EP | 2548783 | A2 | 1/2013 |
| KR | 100837174 | B1 | 6/2008 |
| KR | 20100082162 | A | 7/2010 |
| KR | 101048738 | | 7/2011 |
| KR | 20110095651 | A | 8/2011 |
| RU | 2459735 | | 8/2012 |

* cited by examiner

DEVICE FOR DETECTING OBSTACLES FOR RAIL VEHICLES

CROSS-REFERENCE TO RELATED APPLICATIONS

This is a U.S. national stage of application No. PCT/EP2015/053928 filed 25 Feb. 2015. Priority is claimed on Austrian Application No. A50180/2014 filed 12 Mar. 2014, the content of which is incorporated herein by reference in its entirety.

BACKGROUND OF THE INVENTION

1. Field of the Invention

The present invention relates to a device for detecting obstacles for rail vehicles, comprising a pilot that is attached to the truck (bogie) of a rail vehicle via a mounting device.

2. Description of the Related Art

A foreign object on the railroad track can pose a significant hazard in the event of a collision. Pilots (rail) guards with which an obstacle can be cleared from the line have therefore long been employed in railroad systems. A pilot usually consists of a steel structure having a collision beam at right angles to the direction of travel. The collision beam is fixed to the main frame of the rail vehicle or to the truck frame via a mounting bracket. Various regulations concerning the construction and operation of a rail vehicle stipulate that such a pilot must be disposed in front of the leading wheelset and as closely as possible to the top of the rail.

EP 2 548 783 A2, for example, proposes a collision detection system for a rail vehicle in which a pilot is mounted via a mounting bracket, where, if a predefined collision intensity is exceeded, then a guided displacement of the pilot with respect to the mounting bracket is enabled. Obstacle detection in the sense of differentiated sensing of the collision object is not therefore possible.

The disadvantage of the conventional pilots is that information concerning the collision can only be provided in the form of a yes/no decision. If the intensity of the collision is below a predefined threshold value, then the impact is not registered at all. If the impact intensity was greater, then its actual magnitude remains unknown.

Rail vehicle operators, however, are increasingly demanding that an obstacle detection system sense a collision in a more differentiated manner. For example, the obstacle detection system must be capable of detecting a predefined mass limit value, such as 5 kg, as reliably as possible and if necessary initiate emergency braking of the rail vehicle.

SUMMARY OF THE INVENTION

In view of the foregoing, it is an object of the present invention to provide a device for detecting obstacles for rail vehicles such that a more accurate assessment of the collision mass is possible and which can be manufactured as simply and inexpensively as possible.

This and other objects and advantages are achieved in accordance with the invention by a device having spring elements that are used both for mounting a pilot beam and for measuring the force-time characteristic in the event of a collision. The mounting bracket of the pilot beam is formed by vertically disposed spring elements, preferably leaf springs, where each leaf spring is fixed at an upper end to the truck frame and at a lower end to the pilot beam. Each leaf spring has a transducer in the form of a stress-strain converter. This transducer is disposed between the upper end and the lower end on a broad surface of a leaf spring and is linked to an on-board evaluator via a signal carrying connection. As a result, it becomes possible to detect an obstacle in a differentiated manner, and not only when a fixed collision limit value is exceeded. Interference occurring at high running speeds can be better taken into account for subsequent action. As a result, unwanted brake applications are triggered less frequently.

With respect to susceptibility to interference, it is advantageous if the measurement signal produced by the force measuring device is fed to a signal pre-processing system more or less locally, i.e., via a device disposed on the pilot mounting device. The measurement signal can be, for example, an analog or digital signal. This measurement signal is preferably checked for plausibility and forwarded as an amplified signal to an evaluator.

In a preferred embodiment, the pilot mounting device is formed by at least two vertically disposed spring elements, where each leaf spring is fixed at an upper end to the truck and at a lower end to the pilot. The vertical arrangement ensures that the transducer is not subject to the pilot's own weight. As a result, the measuring device is not subjected to shear forces.

It may be advantageous with respect to manufacturing cost/complexity if the stress-strain converter is a piezoelectric transducer or a strain gage.

Unwanted braking operations can be particularly prevented if the speed of the rail vehicle is taken into account for the on-board signal processing of these transducers. As a result, unwanted braking is a less frequent occurrence particularly at higher running speeds.

Here, it is advantageous if the electronic evaluator comprises a digital computer and is linked into a safety circuit or more specifically an electronic vehicle bus. This means that a brake command generated by the evaluator can be forwarded directly to the appropriate actuator or signaled to the driver.

A simple and robust design can be constructed such that the mounting bracket is formed by two vertically disposed leaf springs, the distance between them corresponding approximately to the width of the truck frame. Each of the leaf springs acts as a fixed beam that is subject to bending stress in the event of collision, and simultaneously as a force sensor that transmits a time-dependent force signal to the evaluator.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference will be made in the following section of the description to drawings from which further advantageous embodiments, details and refinements of the invention will emerge on the basis of non-limiting examples, in which.

DETAILED DESCRIPTION OF THE EXEMPLARY EMBODIMENTS

Figure 1:
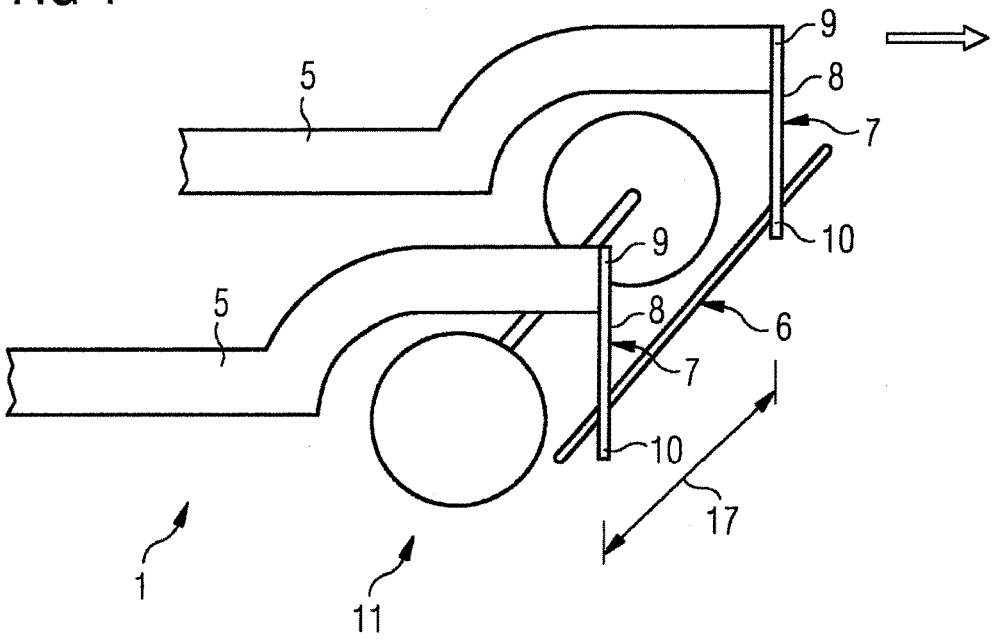
FIG. 1 shows an exemplary embodiment of the invention in which the hanging suspension of the pilot beam via two vertically disposed leaf springs is schematically illustrated.

FIG. 1 shows a schematic view of a truck frame 5 of a rail vehicle 1. The truck frame 5 has a front wheelset 11. Sketched in front of this wheelset 11 in the direction of travel (arrow) is a pilot beam 6 disposed at right angles to the direction of travel. This pilot beam 6 is fixed to the truck frame 5 via a mounting bracket 7.

As will be explained in greater detail below, the mounting bracket 7 not only provides mechanical suspension for the pilot beam 6 but also acts as a force sensor which, in the event of a collision with an obstacle, transforms the collision force occurring into a proportional electrical signal and forwards it to an electronic evaluator.

The mounting bracket 7 is formed as a suspended structure. In the example shown, the mounting bracket 7 basically consists of two vertically disposed spring plates or more specifically leaf springs 8. Each of these leaf springs 8 is formed from spring steel of rectangular cross section. This spring steel 8 is fixed at an upper end 9 to the truck frame. A lower end 10 of each leaf spring 8 is connected to the pilot beam 6 lying at right angles to the direction of travel. This can be a bolted, riveted or welded connection. In the event of a collision, each leaf spring 8 is subject to bending stress like a beam that is fixed at one end.

The distance 17 between the leaf springs 8 corresponds approximately to the width of the truck frame. In the case of externally mounted trucks, the distance is somewhat greater than the track gage, and in the case of internally mounted trucks somewhat less than the track gage.

With respect to their material properties and cross section, the leaf springs 8 are configured to ensure that the vibration and shock occurring particularly when the train is running at high speed do not interfere with the detection of obstacles.

Figure 2:
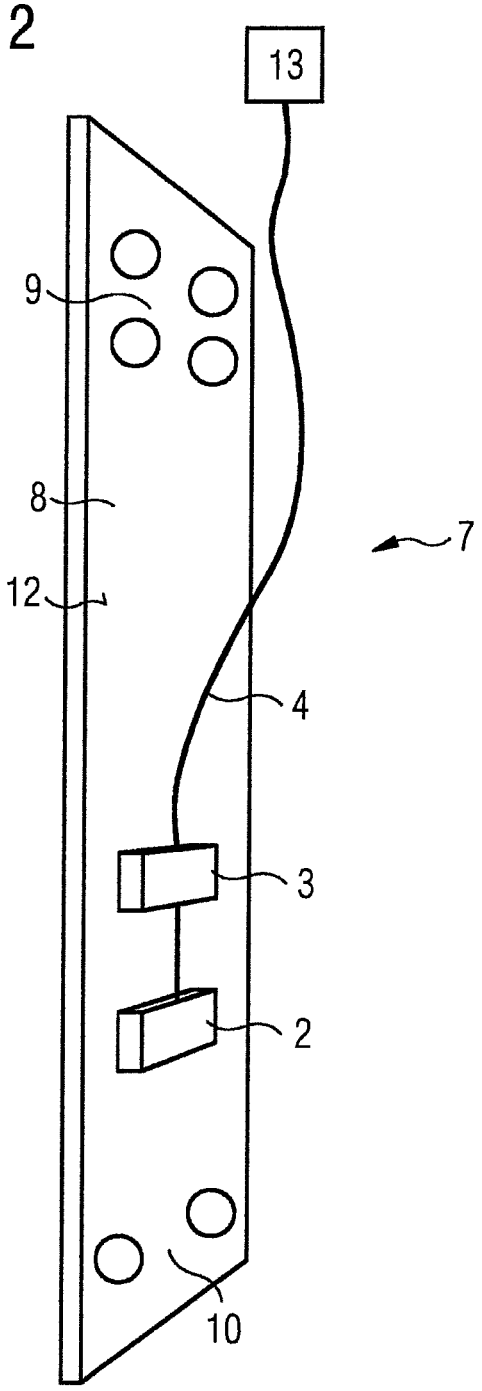
FIG. 2 shows an enlarged representation of a leaf spring from FIG. 1 in which the measuring device is shown enlarged.
Figure 3:
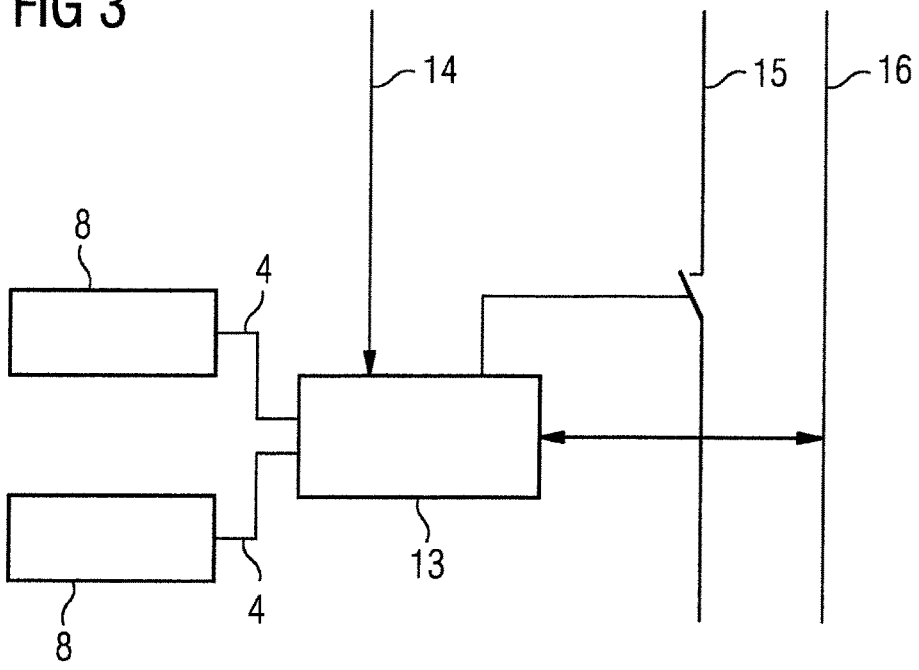
FIG. 3 shows a block diagram illustrating the connection between the measuring device and evaluator and how they are linked into the safety circuit and vehicle bus.

If a collision with an obstacle on the rail or tracked now occurs, the suspended structure is bent back in the direction of the wheelset 11. This deflection of the leaf springs 8 counter to the direction of travel is a measure of the size of the obstacle cleared away by the pilot beam 6. The elastic deformation of the spring steel 8 is measured by a measuring device 2, 3 (FIG. 2). By registering the time characteristic of the force signal during the collision, differentiated detection of the collision object is possible.

A spatial arrangement of the measuring device 2,3 is schematically illustrated in FIG. 2. A stress-strain converter 2 with associated measuring amplifier 3 is shown on a broad surface 12 of a leaf spring 8. The stress-strain converter 2 and the measuring amplifier 3 are disposed between the upper end 9 and the lower end 10 on the same broad surface 12 of the leaf spring 8. Disposed at the upper and lower end are holes by which the leaf spring is bolted to the truck frame or pilot beam as the case may be.

As previously stated, the arrangement of the leaf spring 8 and stress-strain converter 2 acts as a force-displacement transducer: the stress-strain converter 2 converts the elastic deformation of the leaf spring 8 occurring in the event of a collision with an object into a proportional electrical voltage signal. This voltage signal corresponds to an analog force-time characteristic. The signal is first supplied via the connecting line 4 to the measuring amplifier 3 assigned to the transducer 2. The measuring amplifier 3 locally boosts the signal of the stress-strain converter 2 to an appropriate analog level for making the forwarding of the signal as unsusceptible to interference as possible.

The amplified electrical signal is then fed from the measuring amplifier 3 via connecting line 4 to an electronic evaluator 13 on-board the rail vehicle 1. The connecting line 4 is used, on the one hand, to power the transducer 2 and measuring amplifier 3 and, on the other, to convey the signal to the evaluation unit 13. In the following exemplary embodiment, the external unit is a digital computer.

The signal is analyzed and compared in the evaluator 13 with a triggering threshold value dependent on the vehicle speed. If the conditioned measurement signal exceeds a predefined threshold value, then a safety circuit 15 is directly opened and emergency braking of the rail vehicle 1 is initiated. If the conditioned measurement signal remains below a predefinable threshold value, then an indication is sent to the driver via an internal vehicle bus 16. The threshold value is predefined by the evaluator 13 as a function of the speed and possibly other parameters, such as acceleration and shocks.

The advantage of the invention is that a collision is monitored not only as a threshold value (as has been usual hitherto), but that an obstacle can be detected in a differentiated manner. As a result, the triggering threshold can be predetermined depending on the severity of the impact and as a function of the vehicle speed. This means that unwanted braking occurs less often.

The spring steel mounting bracket is mechanically robust and simple to manufacture. Commercially available components can be used as stress-strain converters. A piezo or strain gage can be mounted simply and inexpensively by adhesively bonding it to the leaf spring. All in all, the manufacturing costs of the pilot beam suspension implemented as a force sensor are comparatively low.

Although the invention has been illustrated and described in detail by the preferred exemplary embodiments presented above, the invention is not limited by the examples disclosed and other variations may be inferred therefrom by those skilled in the art without departing from the scope of protection sought for the invention.

Thus, for example, the above described suspension comprising two leaf springs can be implemented by another suspended structure, e.g., having several leaf springs. The vertical arrangement of the leaf springs can also be slightly tilted. Self-evidently, the spring elements can equally well be fixed to a frame structure of the rail vehicle. Likewise, a plurality of transducers and amplifiers can be disposed on a leaf spring, thereby improving the reliability of the measuring device.

Thus, while there have been shown, described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A device for detecting obstacles for a rail vehicle, comprising:

a truck frame;

a mounting bracket comprising a plurality of vertically disposed spring elements; and a pilot beam attached to a truck frame of the rail vehicle in front of a leading wheelset via the mounting bracket;

wherein each spring element is fixed at an upper end to the truck frame and at a lower end to the pilot beam;

wherein each spring element includes a stress-strain converter which is disposed between the upper end and the lower end on a broad surface of a leaf spring; and wherein each stress-strain converter is connected to an on-board evaluator via a signal carrying connection.

2. The device as claimed in claim 1, wherein the signal carrying connection passes via a measuring amplifier assigned to the stress-strain converter and wherein the measuring amplifier is disposed on the broad surface of the leaf spring.

3. The device as claimed in claim 2, wherein the stress-strain converter comprises a piezoelectric transducer.

4. The device as claimed in claim 1, wherein the stress-strain converter is configured as a strain gage.

5. The device as claimed in claim 4, wherein the evaluator is linked to a safety circuit and linked to an electronic vehicle bus.

6. The device as claimed in claim 1, wherein a speed signal of the rail vehicle is supplied to the evaluator, a braking operation being initiated based on said speed signal.

7. The device as claimed in claim 1, wherein the mounting bracket comprises two leaf springs spaced apart by a distance corresponding to a width of the truck frame of the rail vehicle.

* * * * *